United States Patent [19]

Liu et al.

[11] 4,189,054

[45] Feb. 19, 1980

[54] PRODUCT HOLDER

[76] Inventors: Jack F. Liu; Susan L. Liu, both of 4098 Brigadoon Dr., Shoreview, Minn. 55112

[21] Appl. No.: 29,787

[22] Filed: Apr. 13, 1979

[51] Int. Cl.[2] ..... B65D 17/24; B65D 65/28; B65D 75/60

[52] U.S. Cl. ..... 206/634; 220/4 B; 229/2.5 R; 229/87 F; 229/DIG. 13

[58] Field of Search ..... 206/527, 525, 634, 602; 229/2.5 R, 87 F; 220/4 B, 4 F

[56] References Cited

U.S. PATENT DOCUMENTS

| | | | |
|---|---|---|---|
| 1,628,429 | 5/1927 | Radford | 229/87 F |
| 2,027,791 | 1/1936 | Schrager | 229/87 F |
| 3,355,082 | 11/1967 | Wood | 229/DIG. 13 |
| 3,937,389 | 2/1976 | Wind | 220/4 B |
| 3,977,595 | 8/1976 | Hillgenberg | 229/2.5 R |
| 4,109,790 | 8/1978 | Gottschlich | 220/4 B |
| 4,132,344 | 1/1979 | Jewell | 229/2.5 R |

*Primary Examiner*—William T. Dixson, Jr.
*Attorney, Agent, or Firm*—Burd, Bartz & Gutenkauf

[57] ABSTRACT

A container for holding a food product has a pair of articuately connected casings. A lower casing has a generally flat bottom to support the container on a surface. Side walls extended upwardly from the bottom have tear lines that permit the bottom casing to be folded open to facilitate the eating of the food product. The side walls have recesses to facilitate eating of food product from the bottom casing. A top casing hinged to one side of the bottom casing has side walls that extend adjacent the side walls and over the recesses of the bottom casing when the casings are in a closed position. A locking tab cooperates with the top and bottom casings to hold the casings in the closed position.

10 Claims, 8 Drawing Figures

FIG. 1
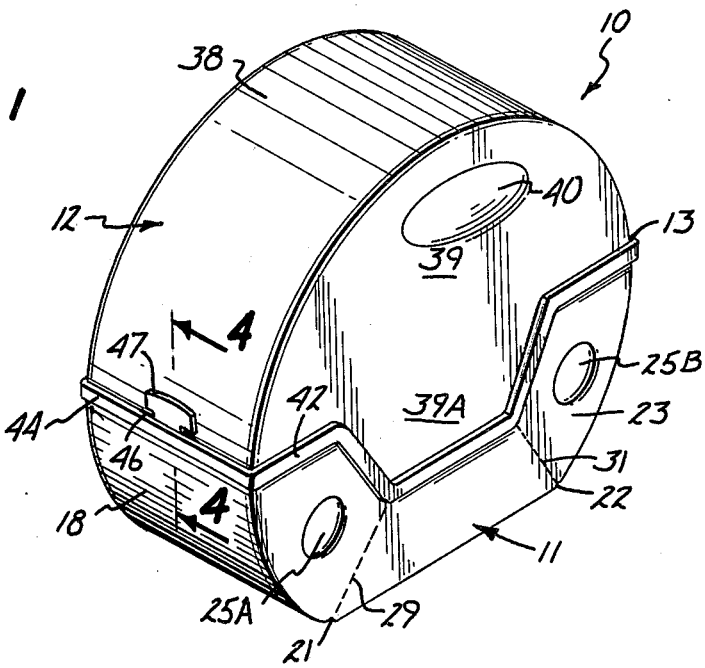
FIG. 4
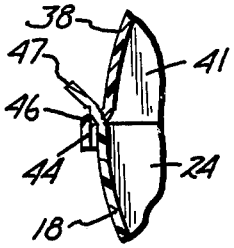
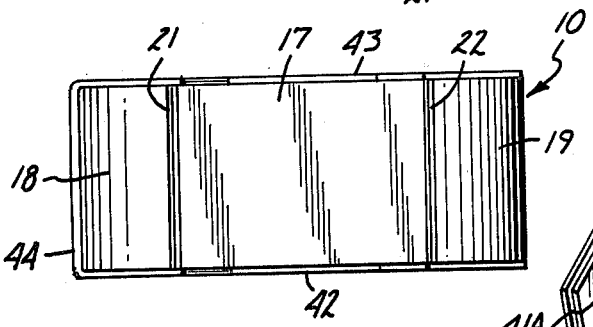
FIG. 3
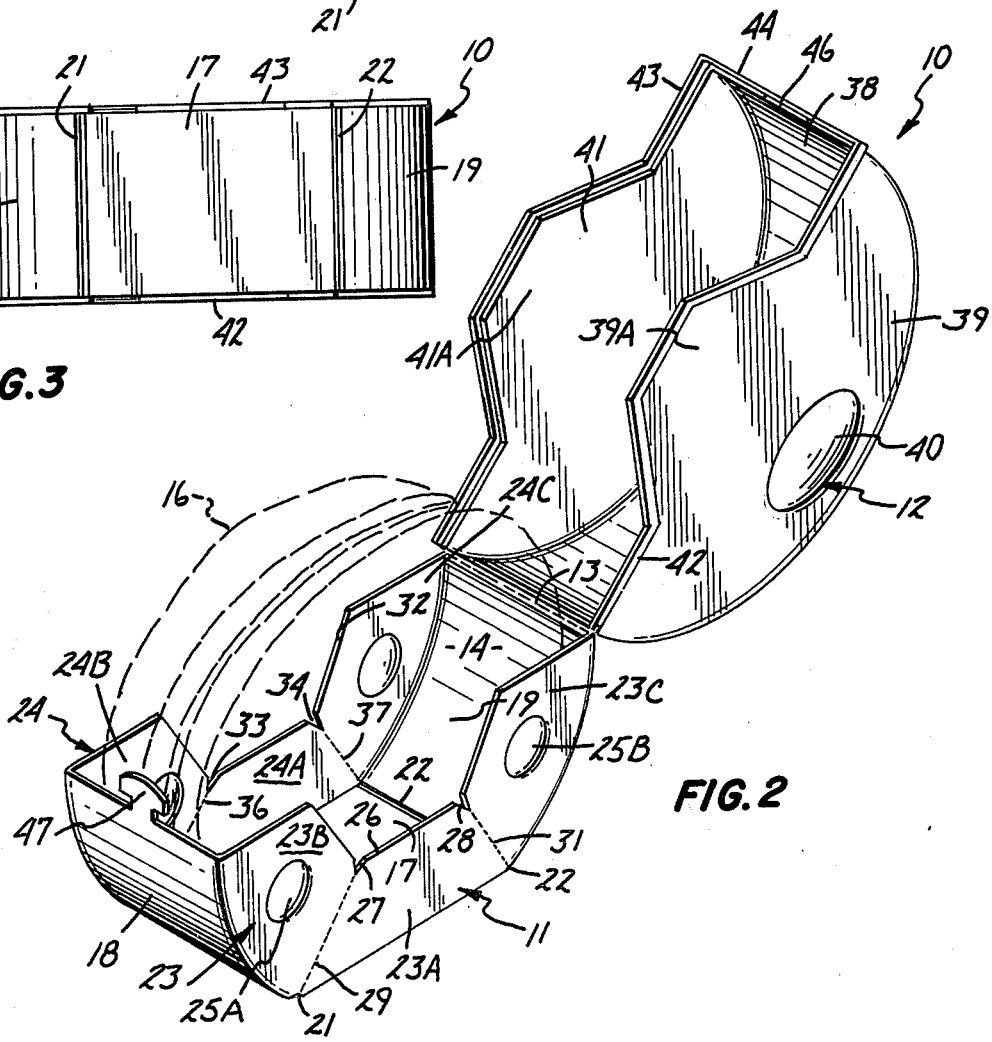
FIG. 2

PRODUCT HOLDER

SUMMARY OF INVENTION

The invention is directed to an apparatus for holding a product. The apparatus is more specifically a holder for a food product, as a sandwich, hamburger, and the like. The holder has a pair of articulately connected casings of a size to surround the food product. The holder is of a size so that it can be easily maneuvered with a single hand.

The first or lower casing has a corrugated generally flat bottom wall to support the holder on a surface and to keep liquid from soaking into the food product. Side walls and end walls complete the first casing. Parts of the side walls can be separated so that the first casing can be folded to an open position to facilitate the eating of the food product. The lower casing functions as a support for the food product and collects liquid and semi-liquid materials that may flow from the food product during the eating of the product. The bottom casing can also be peeled back to facilitate the eating of the food product.

A second or top casing is a cover that is hinged to one side of the first casing. The cover has side walls that extend adjacent the side walls of the first casing when the first and second casings are in a closed position. A locking tab cooperates with the first and second casings to hold the casings in their closed position. The top casing can be removed from the bottom casing to facilitate the eating of the food product. The top casing also has side walls that can be used for identification and promotional printed matter.

IN THE DRAWINGS

FIG. 1 is a perspective view of a product holder of the invention in a closed position;

FIG. 2 is a perspective view of the product holder of FIG. 1 in the open position;

FIG. 3 is a bottom view of FIG. 1;

FIG. 4 is a sectional view taken along line 4—4 of FIG. 1;

DESCRIPTION OF PREFERRED EMBODIMENT

Figure 8:
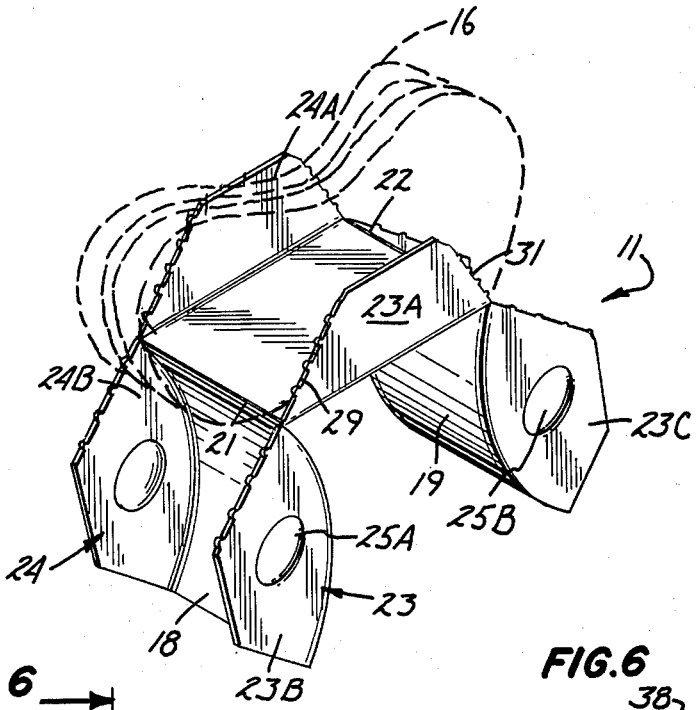
FIG. 8 is a perspective view of the product holder in the full unfolded position.
Figure 5:
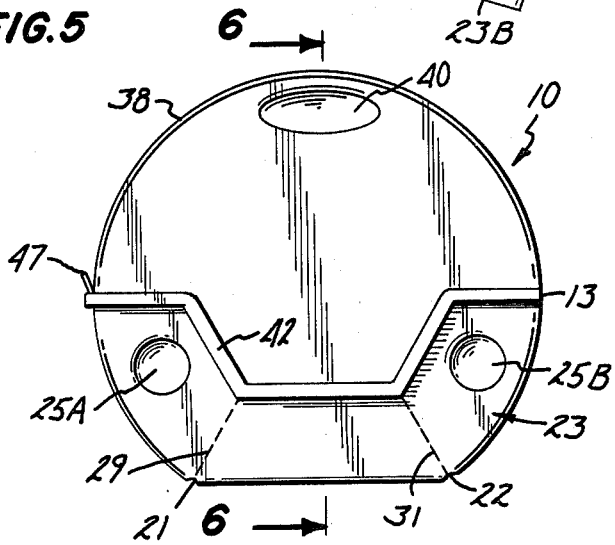
FIG. 5 is a side elevational view of FIG. 1.
Figure 6:
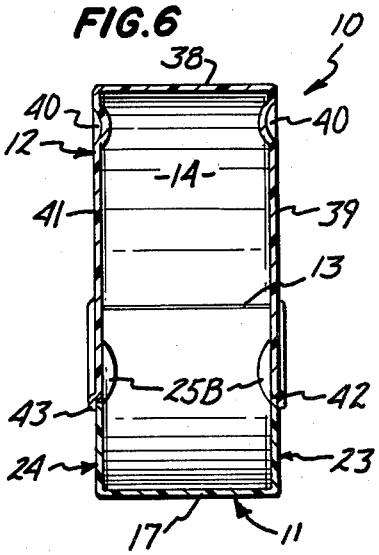
FIG. 6 is a sectional view taken along line 6—6 of FIG. 5.

Referring to FIGS. 1 and 2, there is shown the product holder of the invention indicated generally at 10 adapted to hold and store an object, such as a food product. The food product can be a variety of foods, including, but not limited to, hamburgers, cheeseburgers, hot beef sandwiches, cheese sandwiches, barbecue sandwiches, and the like.

Holder 10 has a pair of articulately connected casings of housings 11 and 12. First casing 11 is hinged to one edge of second casing 12 with a transverse continuous perforated hinge 13. The casings 11 and 12, when in the closed position, define a product accommodating chamber of compartment 14. As shown in FIG. 2, a food product 16 is located in the lower portion of chamber 14. Casing 12 has an unfolded or moved back to expose the upper part of the food product.

Referring to FIG. 3, casing 11 has a generally flat corrugated bottom wall 17 attached to upwardly curved end walls 18 and 19. A transverse fold or crease 21 joins the one end of bottom wall 17 to end wall 18. A second transverse fold line or crease 22 joins the other end of bottom wall 17 to end wall 19. The fold lines 21 and 22 facilitate the bending or turning of the end walls 18 and 19 to a full open position, as shown in FIG. 8.

A first side wall 23 is joined to the bottom wall 17 and end walls 18 and 19. Side wall 23 has three sections 23A, 23B, and 23C. A second side wall 24 is joined to the opposite edge of the bottom wall 17 and end walls 18 and 19 to form a generally elongated cup-like housing having an open top. Side wall 24 has sections similar to the sections 23A, 23B, and 23C of the side wall 23. The side wall sections 23B and 24B have inwardly directed finger recesses 25A which serve to facilitate the gripping of casing 11. Similar finger recesses 25B are located in the side walls 23C and 24C.

Side wall 23 has a generally V-shaped cutout 26 having short V-notches 27 and 28 in the lower corners of cutout 26. A score or tear line 29 extends from V-notch 27 to the end of fold line 21. A second score or tear line 31 extends from V-notch 28 to the end of fold line 22.

Side wall 24 has a generally V-shaped cutout 32 provided with corner V-notches 33 and 34. A first score line 36 extends from V-notch 33 to an end of fold line 22. A second score line 37 extends from V-notch 34 to an end of fold line 22. Tear lines 29, 31, 36, and 37 facilitate the breaking of the casing 11 to a full open position, as shown in FIG. 8. This exposes side portions of the food product 16 so that it can be eaten without removing the food product from the holder 10.

Figure 7:
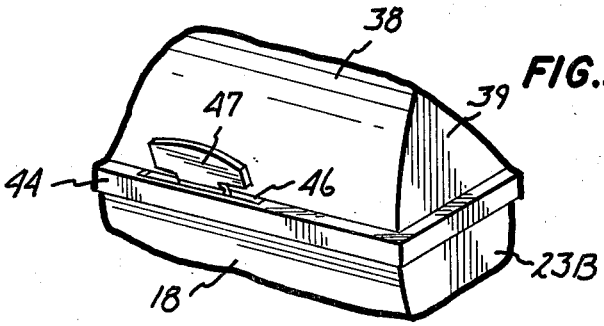
FIG. 7 is a fragmentary perspective view of the end of product holder having the releasable lock.

Casing 12 has a semi-cylindrical top wall 38 and has an edge integral with the transverse continuous hinge 13. First and second side walls 39 and 41 are attached to opposite edges of top wall 38 to provide a cover for closing the open top of casing 12. Side walls 39 and 41 have elongated recesses 40 to facilitate finger gripping of casing 12. Side wall 39 has a U-shaped projection 39A that fits over the U-shaped cutout 26. Side wall 41 has a U-shaped projection 41A that fits over the cutout 32 of side wall 24. Projections 39A and 41A are generally the same size and shape as the cutouts 26 and 32. Projections 39A and 41A can have other shapes including, but not limited to, semi-circular, square, triangular, and the like. Side wall 39 has a continuous side lip 42 adapted to overlap a portion of the side wall 23 of casing 11 when casing 12 is in a closed position. Side wall 41 has a lip 43 that is joined to a transverse end lip 44 located in the opposite end of wall 38 opposite the hinge 13. As shown in FIG. 7, lips 42 and 43 overlap portions of side walls 23 and 24 when casings 11 and 12 are in the closed position.

Referring to FIG. 7, the center portion of lip 44 has a transverse opening or slot 46 accommodating a generally arrowhead shaped tab or lock member 47. As shown in FIG. 2, tab 47 is integral with the center portion of the end of end wall 18. As shown in FIG. 4, tab 47 extends through the opening 46 to hold casings 11 and 12 in the closed position.

Casings 11 and 12 may be made of any suitable materials. These materials can be a foamed plastic, as polystyrene and polyurethane. Casings 11 and 12 can be fabricated from a single mold with the transverse hinge 13 being integrally joined to wall 19 and wall 38. Casings 11 and 12 can be an edible shell or crust material or made from food ingredients, including flour and shortening. The product holder 10, when made of edible material, may be eaten along with the food product. The shape of casings 11 and 12 can vary to accommodate different shaped food products; for example, elongated casings 11 and 12 are used to accommodate hot dogs on a bun.

A preferred embodiment of the product holder of the invention has been shown and described. It is understood that changes in the size, materials, and shape can be made by those skilled in the art without departing from the invention. The invention is defined in the following claims.

The embodiments of the invention in which an exclusive property or privilege is claimed are defined as follows:

1. A holder for a product comprising: first casing means having a first wall, a second wall, and a third wall, first hinge means joining the first and second walls, second hinge means joining the first and third walls, a first side wall attached to the first, second and third walls, a second side wall attached to the first, second and third walls, said first and second side walls having separable sections extended to the first and second hinge means allowing the side walls to be separated, second casing means adapted to be positioned over the first casing means to close the holder, and connecting means attaching the second casing means to the first casing means allowing the second casing means to be moved relative to the first casing means to a position to open the holder.

2. The holder of claim 1 wherein: the first side wall and second side wall each have a cutout and the second casing has side walls that extend over the cutouts.

3. The holder of claim 2 wherein: the cutout has a generally U-shape and is located in the mid-section of the side wall.

4. The holder of claim 2 wherein: the side walls of the second casing have sections generally the same shape as the cutouts.

5. The holder of claim 1 including: recess means in said first and second side walls providing finger grip sections.

6. The holder of claim 1 wherein: the first and second side walls have V-notches aligned with the perforated tear lines.

7. The holder of claim 1 wherein: the second casing means has a semi-cylindrical wall, and first and second side walls joined to the semi-cylindrical wall, said connecting means comprising continuous hinge means articuately connecting the semi-cylindrical wall to the second wall.

8. The holder of claim 1 including: lock means for holding the first casing and second casing in a closed position.

9. The holder of claim 1 wherein: the second casing has side walls that cooperate with the side walls of the first casing to close the holder, said side walls of the second casing having lips adapted to extend over portions of the side walls of the first casing.

10. The holder of claim 1 wherein: the first wall is generally flat.

* * * * *